US006705009B2

(12) United States Patent
Niessner

(10) Patent No.: US 6,705,009 B2
(45) Date of Patent: Mar. 16, 2004

(54) PROCESS FOR PRODUCING MIDDLE ELECTRODE

(75) Inventor: Werner Niessner, Steinheim (DE)

(73) Assignee: Beru AG, Ludwigsburg (DE)

( * ) Notice: Subject to any disclaimer, the term of this patent is extended or adjusted under 35 U.S.C. 154(b) by 253 days.

(21) Appl. No.: 09/828,357

(22) Filed: Apr. 9, 2001

(65) Prior Publication Data

US 2002/0014005 A1 Feb. 7, 2002

(30) Foreign Application Priority Data

May 23, 2000 (DE) ..... 100 25 048

(51) Int. Cl.[7] ..... H01R 43/03

(52) U.S. Cl. ..... 29/879; 29/874; 29/882; 228/160

(58) Field of Search ..... 29/868, 823, 874, 29/882, 879; 228/160

(56) References Cited

U.S. PATENT DOCUMENTS 4,365,137 A * 12/1982 Tarasov et al.
5,179,313 A 1/1993 Eves et al.
RE35,012 E * 8/1995 Takamura et al.
5,558,575 A * 9/1996 Chiu et al.
5,574,329 A * 11/1996 Kagawa
6,132,277 A * 10/2000 Tribble et al.

FOREIGN PATENT DOCUMENTS

| | | |
|---|---|---|
| DE | 28 48 511 C2 | 6/1981 |
| DE | 197 19 937 A1 | 11/1997 |
| EP | 0 491 732 B1 | 5/1996 |
| JP | 04-329286 | 11/1992 |
| WO | WO 00/24098 | 4/2000 |

* cited by examiner

*Primary Examiner*—Carl J. Arbes
(74) *Attorney, Agent, or Firm*—Nixon Peabody LLP; David S. Safran

(57) ABSTRACT

Process for producing a middle electrode with precious metal reinforcement, a middle electrode being used with an ignition tipwhich is tapered relative to the middle electrode body, such that a precious metal wire with a cross section which corresponds to the tapered ignition tip is welded flat onto the tapered ignition tipand such that this precious metal wire is cut off at the desired height, with a sharp edge.

7 Claims, 1 Drawing Sheet

PROCESS FOR PRODUCING MIDDLE ELECTRODE

BACKGROUND OF THE INVENTION

1. Field of the Invention

The invention relates to a middle electrode with precious metal reinforcement, especially a spark plug electrode with a platinum tip and a process for producing a middle electrode.

2. Description of the Related Art

Middle electrodes with precious metal reinforcement are used preferably for spark plugs for high voltage ignition, the reinforcement being accomplished, for example, by the insertion of precious metal spheres, plates, or pins into the middle electrode by welding. A disadvantage arises in that the production of the individual precious metal pieces and their introduction into the middle electrode are very complex in terms of process engineering.

Another disadvantage arises in that the precious metal/nickel alloy welding zone, which is conventionally the base of generic middle electrodes, is exposed to hot gas corrosion and spark erosion so that the resulting damage limits the expected service lifeof the electrode.

SUMMARY OF THE INVENTION

The object of the invention is to make available middle electrodes and processes for their production, which surmount the defects which are known from the prior art. In particular, the middle electrodes will have a high service life expectation, good cold starting properties, and low voltage demand even after long engine running times.

The object of the invention is achieved by a process for producing a middle electrode with precious metal reinforcement, comprising the steps of: providing a middle electrode with an ignition tip, tapering the ignition tip relative to a body of the middle electrode, welding flat a precious metal wire with a cross section which corresponds to the tapered ignition tip onto the tapered ignition tip, and cutting the precious metal wire off at the desired height with a sharp edge. The object is also achieved by a middle electrode with precious metal reinforcement, wherein the middle electrode has a tapered ignition tip, comprising: a precious metal wire with a section with a face side, the wire is bordered on the face side by sharp edges, the section is welded flat, and an alloy area around the area of a contact of the precious metal wire section with the tapered ignition tip, the alloy area extending annularly between the precious metal and the material of the ignition tip of the middle electrode.

The invention is explained in detail with reference to the accompanying drawings.

DETAILED DESCRIPTION OF THE DRAWINGS

Figure 1:
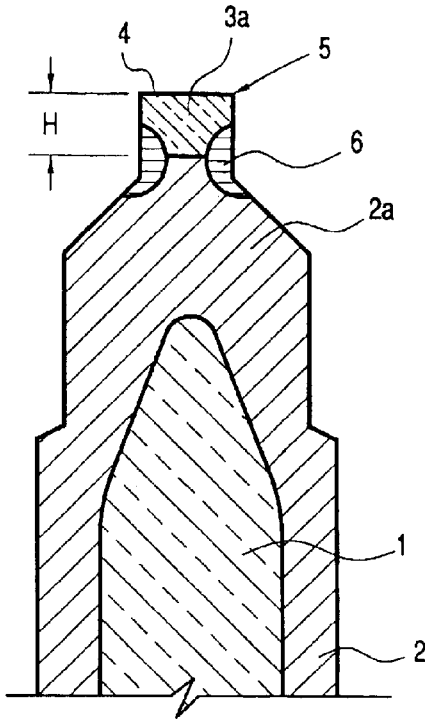
FIG. 1 shows a schematic lengthwise section through the ignition tip area of the middle electrode in accordance with the invention, and FIG. 2 schematically shows one embodiment of the process in accordance with the invention.

In the embodiment shown, the middle electrode according to the invention comprises a core 1 with good thermal conductivity, for example, made of copper, and a jacket 2 of material which is resistant to corrosion by hot gas, preferably a nickel-based alloy.

The middle electrode has a tapered ignition tip 2*a*, this area having a diameter of roughly 2 mm or less. The middle electrode on the ignition side is provided with a section 3*a* of a precious metal wire 3, especially of platinum, as reinforcement. Here, the ignition-side edge area 5 of the section 3*a* is made sharp-edged.

The diameter of the precious metal section 3*a* corresponds here to the diameter of the tapered ignition tip 2*a* of the middle electrode. The precious metal section 3*a* and the tapered ignition tip 2*a* are welded flat on their contact surface by butt-welding process such as resistance welding or friction welding and are welded on the outside periphery by radiation welding such as laser welding. While the electrode wire is first welded flat to the ignition tip 2*a*, after cutting off the electrode wire, by means of radiation welding on the outside periphery in the area of the contact surface, an alloy area 6 is formed in which the materials of the precious metal section 3*a* and of the tapered ignition tip 2*a* are melted into an alloy of both. In this embodiment, the height H of the precious metal section 3*a* is roughly 0.5 mm.

A process for producing the middle electrode is shown schematically in FIG. 2.

Figure 2A:
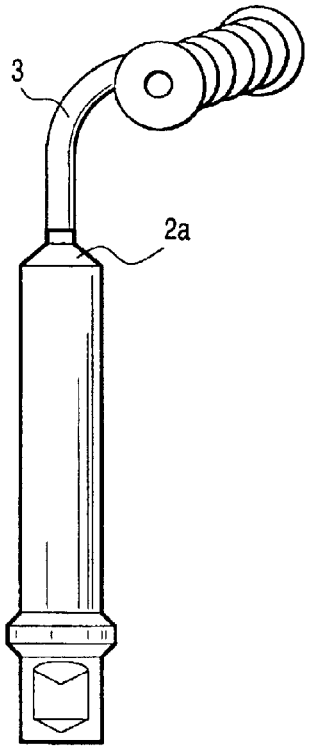

As shown in FIG. 2*a*, a precious metal continuous wire 3 is placed on the tapered ignition tip 2*a* of the middle electrode and welded flat by a butt-welding process, such as resistance welding or friction welding, preferably the diameter of the wire 3 and of the ignition tip 2*a* being the same.

Figure 2B:
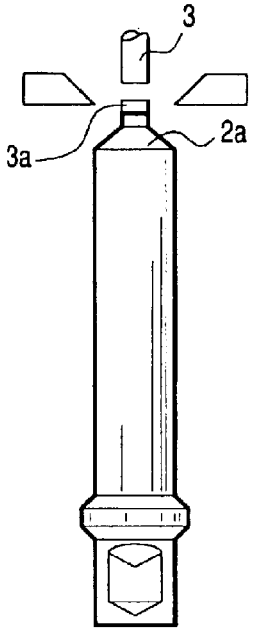
Figure 2C:
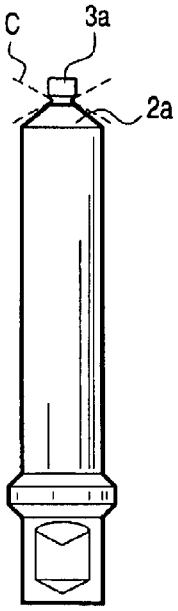

As shown in FIG. 2*b*, the wire 3, except for a residual section 3*a*, is cut off sharp-edged. The alloy formation between the precious metal wire section 3*a* and the ignition tip 2*a* takes place as shown in FIG. 2*c* in the outer area 6 of their resting on one another by radiation welding C, preferably laser welding, with the formation of an alloy of the precious metal with the jacket material of the middle electrode.

The process in accordance with the invention is extremely advantageous due to the circumstance that instead of producing individual insert pieces from precious metal, as described initially, continuous precious metal wire can be used which is much lighter and can be handled much more easily.

Welding of the continuous wire with conventional resistance welding means can be easily accomplished.

Cutting off the continuous wire allows formation of sharp edges with the corresponding cutting tools; these sharp cut edges are especially effective for restarts and cold starts, because they reduce the voltage requirement.

The service life expectation of the middle electrode as claimed in the invention is more than 100,000 kilometers. By forming an alloy between the precious metal and the material of the middle electrode jacket, hot gas corrosion attacks, spark erosion and chemical attacks on the weld site of the precious metal reinforcement and the middle electrode are prevented. In addition, good mixing accessibility is caused by the tapering of the middle electrode.

It was found that when sparks form on the middle electrode of the invention, the tapered ignition tip and the formation of a platinum/nickel alloy in the resistance welding result in the effect that, in the break-through phase, the spark forms in the extremely small ignition gap between the middle electrode and ground electrode. In the arc phase and in the glow phase, the spark alternates from the precious metal to the "base" metal, i.e., the spark alternates from the platinum to the nickel alloy of the middle electrode so that the actual spark-erosive burnup takes place at the point of the middle electrode which does not influence the voltage demand of the spark gap. The ignition gap between the middle electrode (the ignition-side spark emergence surface is composed completely of precious metal) and the ground electrode, which may likewise be reinforced with precious metal, remains relatively constant so that high service lives are accomplished. Another advantage arises finally in that the spark moves from the tapered ignition tip which is reinforced with precious metal in the direction of the middle electrode by the above described effect and thus in the arc and glow phase (here the current flows which ignites the mixture) forms a longer plasma channel; this in turn leads to improved ignition of the mixture.

What is claimed is:

1. A process for producing a middle electrode with precious metal reinforcement, comprising the steps of:

providing a middle electrode with an ignition tip, tapering the ignition tip relative to a body of the middle electrode, welding a flat end of a precious metal wire with a cross section which corresponds to the tapered ignition tip onto the tapered ignition tip, and cutting the precious metal wire off at a desired height with a sharp edge.

2. The process as claimed in claim 1, wherein the ignition tip is tapered to a diameter of 2 mm or less.

3. The process as claimed in claim 1, wherein the ignition tip is tapered to a diameter of 1 mm or less.

4. The process as claimed in claim 1, wherein a continuous precious metal wire is used with a diameter which is 2 mm or less.

5. The process as claimed in claim 1, wherein a continuous precious metal wire is used with a diameter which is 1 mm or less.

6. The process as claimed in claim 1, wherein the precious metal wire is cut off to a residual section of a height from 0.3 to 1.0 mm with a sharp edge.

7. The process as claimed in claim 1, wherein the tapered ignition tip of the middle electrode is joined to the precious metal wire by resistance welding.

* * * * *